US007887036B2

(12) United States Patent
Hayashi et al.

(10) Patent No.: US 7,887,036 B2
(45) Date of Patent: Feb. 15, 2011

(54) SHEET PROCESSING APPARATUS AND IMAGE FORMING APPARATUS

(75) Inventors: Kenichi Hayashi, Abiko (JP); Hideki Kushida, Moriya (JP); Hitoshi Fujimoto, Abiko (JP); Takaharu Hayasaka, Toride (JP); Shigeo Doi, Toride (JP)

(73) Assignee: Canon Kabushiki Kaisha (JP)

( * ) Notice: Subject to any disclaimer, the term of this patent is extended or adjusted under 35 U.S.C. 154(b) by 369 days.

(21) Appl. No.: 12/188,403

(22) Filed: Aug. 8, 2008

(65) Prior Publication Data

US 2009/0039585 A1 Feb. 12, 2009

(30) Foreign Application Priority Data

Aug. 8, 2007 (JP) ..... 2007-207256
Jul. 29, 2008 (JP) ..... 2008-194492

(51) Int. Cl.
*B65H 37/04* (2006.01)

(52) U.S. Cl. ..... 270/58.07; 270/52.17; 270/58.11; 270/58.08; 270/37; 412/4; 412/16; 412/18; 412/19; 412/25; 412/32; 412/33

(58) Field of Classification Search ..... 270/21.1, 270/37, 52.17, 58.07, 58.08, 58.09, 58.11; 412/3, 4, 16, 18, 19, 23, 25, 32, 33
See application file for complete search history.

(56) References Cited

U.S. PATENT DOCUMENTS 2,206,394 A * 7/1940 Farkas ..... 281/27.1
3,608,116 A * 9/1971 Melgaard et al. ..... 412/17
6,966,552 B2 * 11/2005 Trovinger et al. ..... 270/52.17
7,490,860 B2 * 2/2009 Didde ..... 281/40

FOREIGN PATENT DOCUMENTS

JP 9-165136 A 6/1997
JP 2004-284750 A 10/2004

* cited by examiner

*Primary Examiner*—Leslie A Nicholson, III
(74) *Attorney, Agent, or Firm*—Rossi, Kimms & McDowell LLP

(57) ABSTRACT

A current invention provides a sheet processing apparatus and an image forming apparatus capable of obtaining a sheet bundle which can be double-leaved and released without use of any binding device. A slit S to which a projection Pa provided at an end portion opposite to a side to be bound by a binding portion of a front cover P1 is formed in a back cover P3 of a sheet bundle PA by an insertion portion forming portion. Further, creases L1, L2 for inserting the projection Pa into the slit S while surrounding sheets P2 existing between the front cover P1 and the back cover P2 are formed in the back cover P3 of the sheet bundle PA by a crease forming portion.

11 Claims, 18 Drawing Sheets

SHEET PROCESSING APPARATUS AND IMAGE FORMING APPARATUS

BACKGROUND OF THE INVENTION

1. Field of the Invention

The present invention relates to a sheet processing apparatus and image forming apparatus and more particularly to the sheet processing apparatus and image forming apparatus which perform a processing of binding a sheet bundle having a front cover and a back cover.

2. Description of the Related Art

In recent years, diversification of information has been accelerated and accompanied by this, an opportunity for a person to output a content having a high confidentiality from a printer which is an example of the image forming apparatus individually and possess it has been increased. Such an output needs to be treated so that the content thereof cannot be seen easily by other people.

To solve this problem, there have been invented a plurality of methods for blocking a bookbound matter from being opened so that the content is hard to see by binding a fore edge, or an end opposite to a bound end of the bookbound matter temporarily (see Japanese Patent Application Laid-Open Nos. 2004-284750 and 9-165136).

FIG. 18A illustrates an example of the method for blocking bookbound matter from being opened. Folded sheets S having perforations b at a bent portion are overlaid and the fore edge is bound with binding devices, for example, needles SP to make the bookbound matter double-leaved. In the meantime, this bookbound matter can be seen by separating across the perforations b.

The bookbound matter shown in FIG. 18B is double-leaved by binding the fore edge of sheet bundles SA each side-stitched, using the needles SP. This bookbound matter allows its content to be seen by removing the needles SP which bind the fore edges.

However, in case of the conventional bookbound matter formed in this way, if the binding devices are removed to see the content thereof, it is difficult to return the state to the original bound condition. Particularly, in case of a bookbound matter having a large number of sheets, once the double-leaved sheets are released, it cannot be double-leaved again using a marketed stapler and if the fore edges are bound with the stapler again, a plurality of holes are made in the bookbound matter, thereby producing a bad appearance of the sheets.

Further, when any binding device is removed from the fore edge to release the double-leaved sheets, if no care is taken, the sheet might be torn out or bent.

Accordingly, the present invention has been achieved in views of such a circumstance and the present invention intends to provide a sheet processing apparatus and image forming apparatus capable of producing double-leaved sheets and released that binding condition, without use of any binding device.

SUMMARY OF THE INVENTION

The present invention provides a sheet processing apparatus which performs a processing of forming a sheet bundle having a front cover and a back cover, comprising: a projection forming portion which forms a projection portion in an end portion of any one of the front cover and the back cover of the sheet bundle; an insertion portion forming portion which forms an insertion portion to which the projection is to be inserted in the other one of the front cover and the back cover; and a binding portion which binds an opposite end portion of the sheet bundle to the end portion in which the projection is formed.

By forming the insertion portion in any one of the front cover and the back cover of the sheet bundle and forming the creases for inserting the projection into the insertion portion while surrounding the sheets in the other one of the front cover and the back cover, a sheet bundle which can be double-leaved and released from that state without use of any binding device can be obtained.

Further features of the present invention will become apparent from the following description of exemplary embodiments with reference to the attached drawings.

DESCRIPTION OF THE EMBODIMENTS

Hereinafter, the exemplary embodiment of the present invention will be described in detail with reference to the accompanying drawings.

Figure 1:
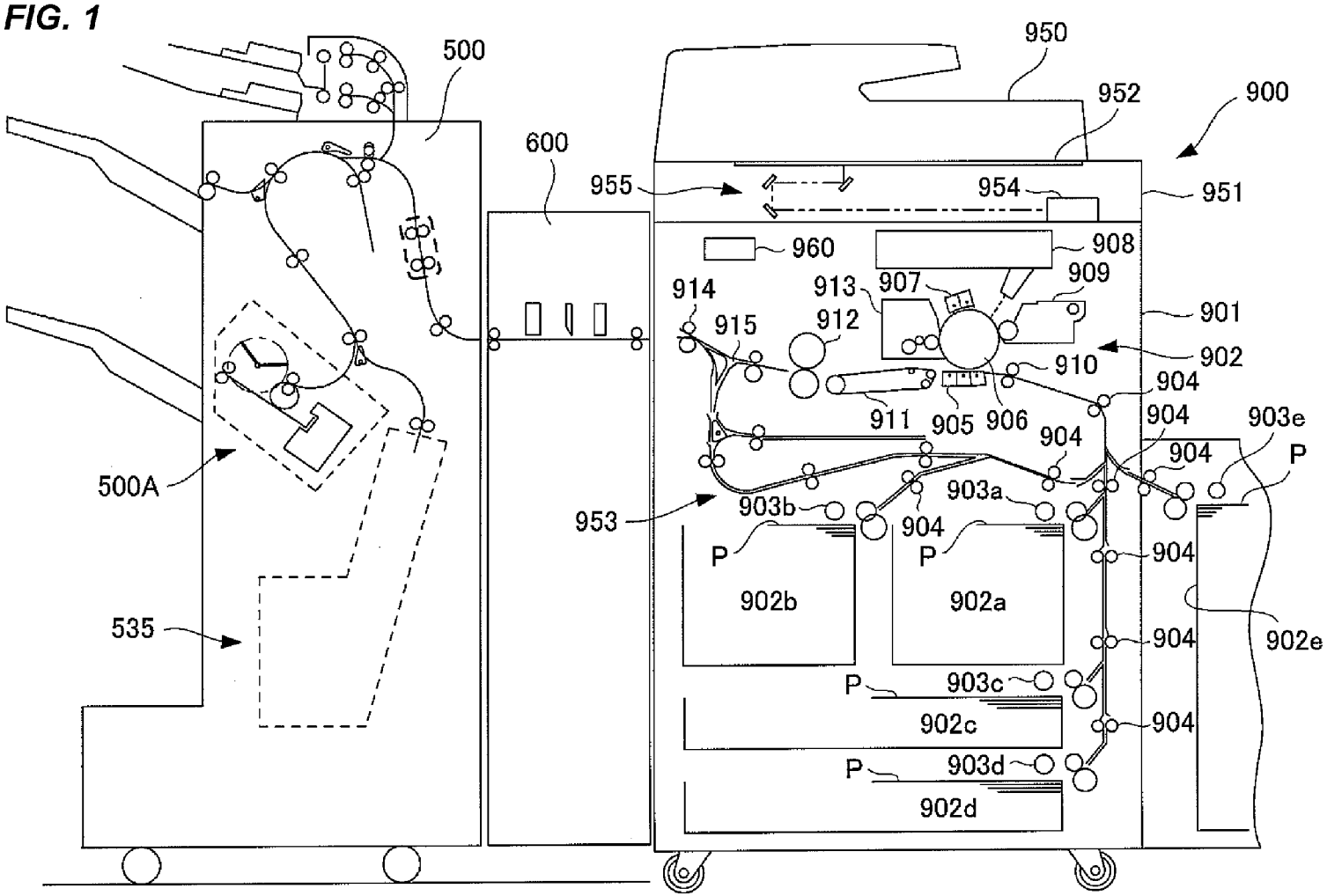
FIG. 1 is a sectional view of a sheet processing apparatus and an image forming apparatus according to a first embodiment of the present invention.

FIG. 1 is a sectional view of an image forming apparatus having a sheet processing apparatus according to a first embodiment of the present invention.

Referring to FIG. 1, an image forming apparatus 900 and an image forming apparatus main body 901 are shown. The image forming apparatus main body 901 includes an image reading unit 951 having a scanner unit 955 and an image sensor 954, an image forming portion 902 for forming an image on a sheet, a duplex face inverting unit 953 and a platen glass 952. An original feeding unit 950 for feeding an original onto the platen glass 952 is provided on the top face of the image forming apparatus main body 901.

The image forming portion 902 includes a cylindrical photosensitive drum 906, a charger 907, a developing device 909, and a cleaning device 913. Further, a fixing device 912 and a discharge roller 914 are disposed in the downstream of the image forming portion 902.

Next, an image forming operation of the image forming apparatus main body 901 having such a structure will be described.

If an image forming signal is output from a controller 960, an original is placed on the platen glass 952 by the original feeding unit 950 and an image of this original is read by the image reading unit 951 and then, read digital data is input to an exposure portion 908. Then, light corresponding to this digital data is irradiated to the photosensitive drum 906 by the exposure portion 908.

At this time, the surface of the photosensitive drum 906 is charged equally by the charger 907 and when light is irradiated thereto, an electrostatic latent image is formed on the surface of the photosensitive drum. By developing this electrostatic latent image with the developing device 909, a toner image is formed on the surface of the photosensitive drum.

On the other hand, when a sheet feeding signal is output from the controller 960, first, a sheet P set in cassettes 902*a*-902*e* is conveyed to a registration roller 910 by sheet feeding rollers 903*a*-903*e* and conveyer roller pairs 904.

Next, the sheet P is conveyed to a transfer portion having a transfer separating charger 905 by the registration roller 910 at a timing for matching an end of the sheet with the front end of the toner image on the photosensitive drum 906. A transfer bias is applied to the sheet P by the transfer separating charger 905 in this transfer portion, so that the toner image on the photosensitive drum 906 is transferred to the sheet side.

Next, after the sheet P having the transferred toner image is conveyed to the fixing device 912 by the conveyer belt 911, the toner image is fixed thermally by the fixing device 912. At this time, foreign matter such residual toner adhering to the photosensitive drum 906 without being transferred to the sheet is scraped off by a blade of the cleaning device 913. As a result, the surface of the photosensitive drum 906 is cleared to prepare for a next image formation.

The fixed sheet is discharged to the finisher 500, which is the sheet processing apparatus described later one by one by the discharge roller pairs 914 or conveyed to the duplex face inverting unit 953 by switching by a switching portion 915 so as to perform image formation again.

By the way, the image forming apparatus main body 901 is provided with the finisher 500. The finisher 500 fetches in sheets from the image forming apparatus main body 901, aligns the fetched plural sheets and performs a processing for bundling the sheets into a sheet bundle, sort processing and non-sort processing.

Further, the finisher performs binding processing for binding the rear ends of the sheet bundle or bookbinding processing, and includes a binding portion 500A for binding sheets and a saddle unit 535 which is a binding portion for binding the sheet bundle by folding. Further, it further includes a double-leaved booklet processing portion 600 for processing sheets discharged from the image forming apparatus main body 901 into a double-leaved booklet.

Figure 2:
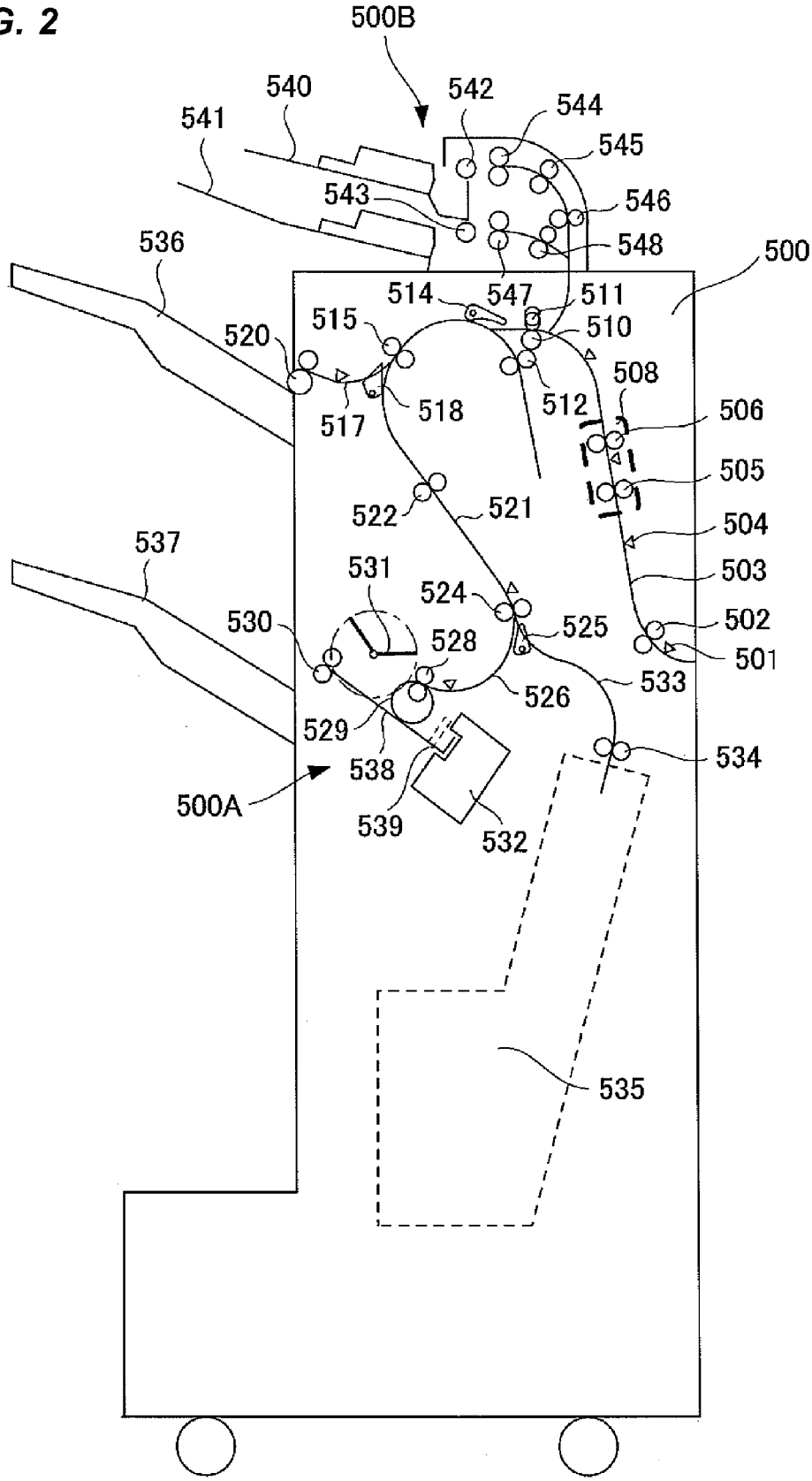
FIG. 2 is a diagram for illustrating the structure of a finisher which is the sheet processing apparatus.

As shown in FIG. 2, this finisher 500 includes an intake roller pair 502 for fetching the sheets conveyed through the double-leaved booklet processing portion 600 into the interior of the apparatus and the sheet discharged from the image forming apparatus main body 901 is transferred to the intake roller pair 502. In the meantime, at this time, a sheet transfer timing is detected by an intake sensor 501.

After that, the sheet conveyed by the intake roller pair 502 passes a conveying path 503 and an end position of this sheet is detected by a side registration detecting sensor 504, so that how much side registration error is produced with respect to the center position of the finisher 500 is detected.

After the side registration error is detected, the shift unit 508 moves at a predetermined amount in a forward direction or to a deeper side while the sheet is conveyed by the shift roller pairs 505, 506, so as to shift the sheet.

Next, the sheet is conveyed by a conveying roller 510 and a retractable roller 511 and reaches a first buffer roller pair 515. If the sheet is discharged to a top tray 536 after this, an upper path switching portion 518 is moved clockwise by a driving portion of a solenoid (not shown). Consequently, the sheet is introduced to an upper conveying path 520 and discharged to the top tray 536 by a top discharge roller 520.

If the sheet is not discharged to the top tray 536, the sheet conveyed by a first buffer roller pair 515 is introduced to a bundle conveying path 521 by the upper path switching portion 518 in a state shown in FIG. 2. After that, the sheet passes within the conveying path successively by means of a second buffer roller pair 522 and a bundle conveying roller pair 524.

Next, to discharge the conveyed sheet to a bottom tray 537, the sheet is conveyed to a lower path 526 by a saddle path switching portion 525 in a state shown in FIG. 2. After that, the sheet is discharged to an intermediate processing tray 538 by a lower discharge roller pair 528. Then, the discharged sheets are aligned by a predetermined number on the intermediate processing tray by a returning portion such as a paddle 531 and a knurling belt 529.

The sheet bundle aligned on the intermediate processing tray is bound by a stapler 532 which constitutes a binding unit as required and after that, discharged to the bottom tray 537 by a bundle discharge roller pair 530. In the meantime, this stapler 532 is movable in a direction perpendicular to the direction of discharging the sheet (hereinafter referred to as deep side direction) and can bind the rear end portion of the sheet bundle at plural positions. The intermediate processing tray 538 is provided with a line sensor 539 capable of detecting the thickness of stacked sheets.

On the other hand, when the sheets are saddle stitched, the saddle path switching portion 525 is moved counterclockwise by the driving portion of the solenoid (not shown). Consequently, the sheets are conveyed to the saddle path 533, introduced to the saddle unit 535 by a saddle intake roller pair 534 and saddle stitched.

In the meantime, reference numeral 500B in FIG. 2 designates an inserter provided on the top of the finisher 500. This inserter 500B is used for inserting other sheet (insert sheet) than ordinary sheets in between a head page and an end page of the sheet bundle or sheets on which an image is formed by the image forming apparatus main body 901.

This inserter 500B conveys an insert sheet set on insert trays 540, 541 to any one of the top tray 536, the intermediate processing tray 538 and the saddle unit 535 without passing through the image forming apparatus main body 901.

When an insert sheet is inserted into a bundle of sheets containing formed image by the inserter 500B, the insert sheet set on the insert trays 540, 541 is conveyed by pickup rollers 542, 543.

Then, this insert sheet is conveyed by conveying rollers 544, 545, 546, 547, 548 and converged on the upstream side of the conveying roller 510 and the retractable roller 511 of the finisher 500. After that, it is conveyed to any one of the top tray 536, the intermediate processing tray 538 and the saddle unit 535 like the sheet discharged from the image forming apparatus main body 901.

Figure 3:
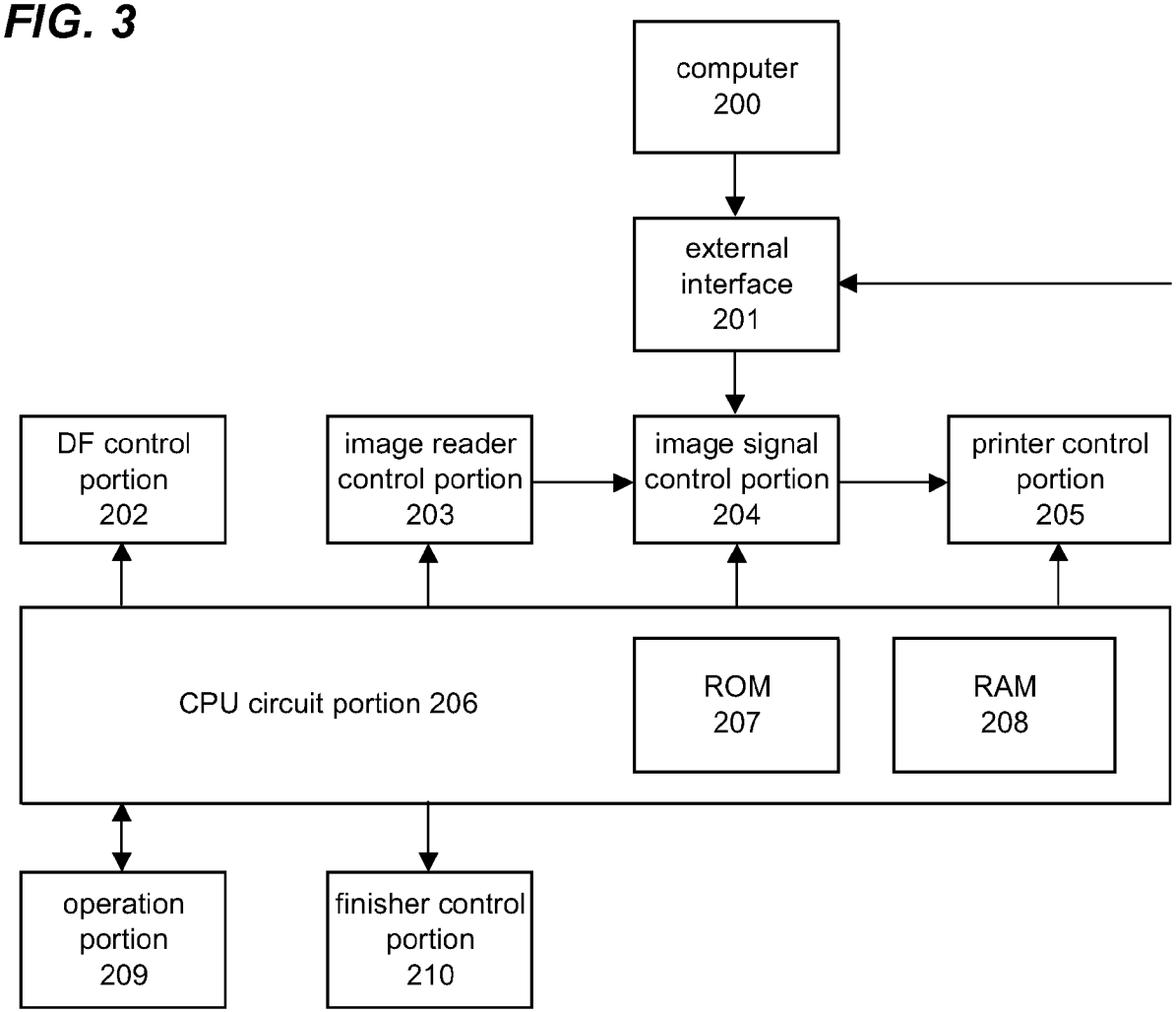
FIG. 3 is a control block diagram of the image forming apparatus.

FIG. 3 is a control block diagram of the image forming apparatus 900 and in FIG. 3, a CPU circuit 206 provided on a controller 960 includes a CPU (not shown), a ROM 207 which stores control program and the like, an area which stores the control data temporarily and a RAM 208 used as a working area for arithmetic operation for control.

In FIG. 3, an external interface 201, which is an interface between the image forming apparatus 900 and an external computer 200 receives print data from the computer 200, develops this data to a bit map image and outputs it to an image signal control portion 204 as image data.

Then, this image signal control portion 204 outputs this data to a printer control portion 205 and the printer control portion 205 outputs data from the image signal control portion 204 to an exposure control portion (not shown). An image of an original read by the image sensor 954 (see FIG. 1) is output from an image reader control portion 203 to the image signal control portion 204 and the image signal control portion 204 outputs this image output to the printer control portion 205.

An operation portion 209 includes a plurality of keys for setting various kinds of functions for image formation and a display portion for displaying a setting condition. It outputs a key signal corresponding to an operation of each key by user to a CPU circuit portion 206 and displays corresponding information based on a signal from the CPU circuit portion 206 on a display portion.

The CPU circuit portion 206 controls the image signal control portion 204 following a control program stored in the ROM 207 and a setting of the operation portion 209 and then controls an original feeding unit 950 (see FIG. 1). Further, the CPU circuit portion 206 controls the image reading unit 951 through the image reader control portion 203 (see FIG. 1), the image forming portion 902 through the printer control portion 205 (see FIG. 1) and the finisher 500 through the finisher control portion 210.

In the meantime, according to this embodiment, the finisher control portion 210 is mounted on the finisher 500 and controls the driving of the finisher 500 by exchanging information with the CPU circuit portion 206. Further, the finisher control portion 210 may be disposed integrally with the CPU circuit portion 206 on the image forming apparatus main body 901 side so as to control the finisher 500 directly from the image forming apparatus main body 901 side.

Further, the CPU circuit portion 206 controls a sheet processing operation of the double-leaved booklet processing portion 600 through the finisher control portion 210. In the meantime, if the finisher 500 is used off line, the finisher control portion 210 controls the sheet processing operation of the double-leaved booklet processing portion 600 directly.

Next, the structure of the double-leaved booklet processing portion 600 will be described with reference to FIG. 4.

Figure 4:
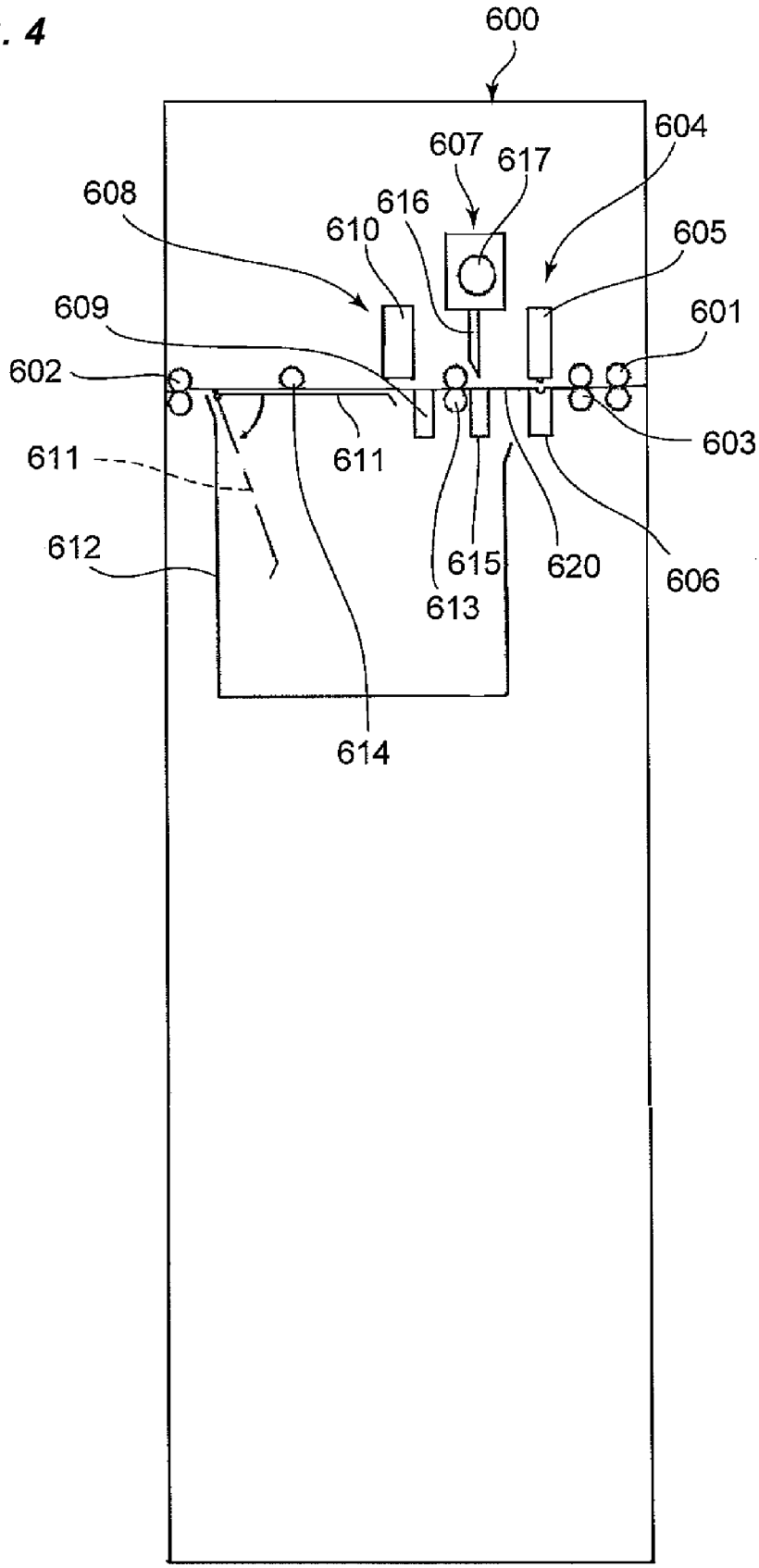
FIG. 4 is a diagram for illustrating the structure of a double-leaved booklet processing portion provided on the finisher.

In FIG. 4, there are shown an intake roller 601 for receiving a sheet from the image forming apparatus main body 901, a discharge roller 602 for discharging the sheet to the finisher 500 and a horizontal path 620. This horizontal path 620 has a registration roller pair 603, a creasing portion 604, a cutter portion 607, a conveying roller pair 613, a one side conveying roller 614, a cutting portion 608 and a shutter 611 in order from the upstream. In the meantime, reference numeral 612 designates a trash box disposed below the shutter 611.

The one side conveying roller 614 conveys the sheet by sandwiching the sheet with the shutter 611 in a closed state as described later. The registration roller pair 603 corrects the registration by making a loop on the sheet by a conveyance force of the intake roller 601 with the front end of the sheet conveyed stopped temporarily by means of a nipping portion thereof and repeats rotation and stop at a predetermined timing by means of a clutch (not shown).

The creasing portion 604 constitutes a crease forming portion for forming a crease on any one of the front cover and back cover of the sheet bundle, in this embodiment, the back cover. Then, this creasing portion 604 includes an upper pressing die 605 having a convex shape extending in the deep side direction and a lower pressing die 606 having a concave shape extending in the deep side direction, those pressing dies being disposed across the horizontal path 620.

In the meantime, the top surface of the lower pressing die 606 is located at a substantially the same position as a sheet passage face of the horizontal path 620. The upper pressing die 605 is moved vertically between a separation position where it is retracted upward from the sheet passage face of the horizontal path 620 shown in FIG. 4 and a pressing position where it sandwiches the sheet together with the lower pressing die 606 to press it, by a driving portion (not shown).

Accompanied by a movement of the upper pressing die 605 up to the pressing position, the sheet is pressed and a die shape is transferred to the pressed sheet so that the crease is printed. In this embodiment, a second crease is printed on the back cover as described later.

The cutter portion 607 constitutes an insertion portion forming portion for forming a slit which is an insertion portion in any one of the front cover and the back cover, in this embodiment, the back cover. This cutter portion 607 includes a cutter 616 which can be moved in the deep side direction along a rail 617 by means of a driving portion (not shown) and a die 615 provided at a position opposing the cutter 616.

In the meantime, the die 615 is provided at the same height as the sheet passage face of the horizontal path 620 for a passage of the sheet not to be disturbed. The cutter 616 is moved vertically between a cutting position where it cuts the sheet and the separation position where it is retracted upward from the sheet passage face of the horizontal path 620 shown in FIG. 4 by a driving portion (not shown). As a result of this movement in the vertical direction, a slit of a specified length is formed in the sheet.

The cutting portion 608 constitutes a projection forming portion portion for forming a projection to be inserted into a slit formed in the back cover by the cutter portion 607 described previously on the end portion of other one of the front cover and the back cover, in this embodiment, of the front cover. The cutting portion 608 forms the projection on the front end portion of the sheet which passes the horizontal path 620 and as shown in FIG. 5, includes an upper blade unit 610 having a convex portion 610*a* and a lower blade unit 609 having a projection 609*a*.

Figure 5:
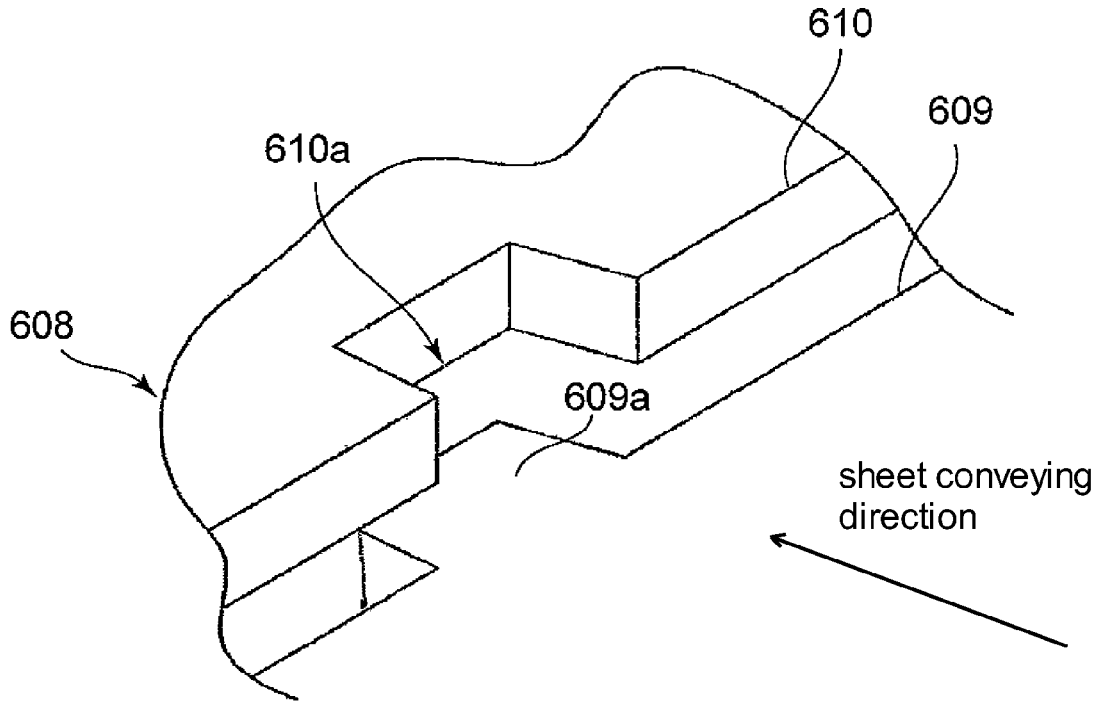
FIG. 5 is a diagram for illustrating the structure of a cutting portion provided on the double-leaved booklet processing portion.

This upper blade unit 610 is moved between a retraction position where it is retracted upward from the sheet passage face of the horizontal path 620 shown in FIG. 5 and a cutting position where it cuts the sheet together with the lower blade unit by means of a driving portion (not shown).

The shutter 611 rotates downward interlocked with a movement of the upper blade unit 610 to the cutting position to allow a front end portion of the sheet cut to waste by the upper blade unit 610 to drop into the trash box 612 so as to accommodate in the trash box 612. A solid line of the shutter 611 shown in FIG. 4 indicates a state for conveying the sheet to the downstream in cooperation with the one side conveying roller 614 and a dotted line indicates a state for allowing an unnecessary portion to drop into the trash box. In the meantime, the trash box 612 can accommodate trash generated by processing of the cutter portion 607.

Next, a processing operation which enables the finisher 500 containing the double-leaved booklet processing portion 600 having such a structure to perform the double-leaved booklet processing upon the sheet bundle will be described.

In this case, the cassettes 902*a*, 903*b* of the image forming apparatus main body 901 accommodate half-size sheets (for example A4 size) and the cassettes 902*c*, 902*d* accommodate large size sheets (for example, A3 size).

Here, the width dimensions of the half size and large size sheets are the same. The sheets accommodated in the cassettes 902*b*, 902*c* and 902*d* are thick papers having grammage of 200 g/m$^2$. On the other hand, the sheets accommodated in the cassette 902*a* are plain paper and the plain paper having a grammage of 80 g/cm$^2$ is used here.

Next, if an operator sets a double-leaved booklet processing mode using the operation portion 209, the large size front cover P1 is sent from the cassette 902*c* or the cassette 902*d*. A desired image is formed on the front cover P1 sent in this way and after that, it enters the double-leaved booklet processing portion 600 and is conveyed while sandwiched by the intake rollers 601. At this time, the creasing portion 604, the cutter portion 607 and the cutting portion 608 of the double-leaved booklet processing portion 600 are in standby condition as shown in FIG. 4.

Figure 6A:
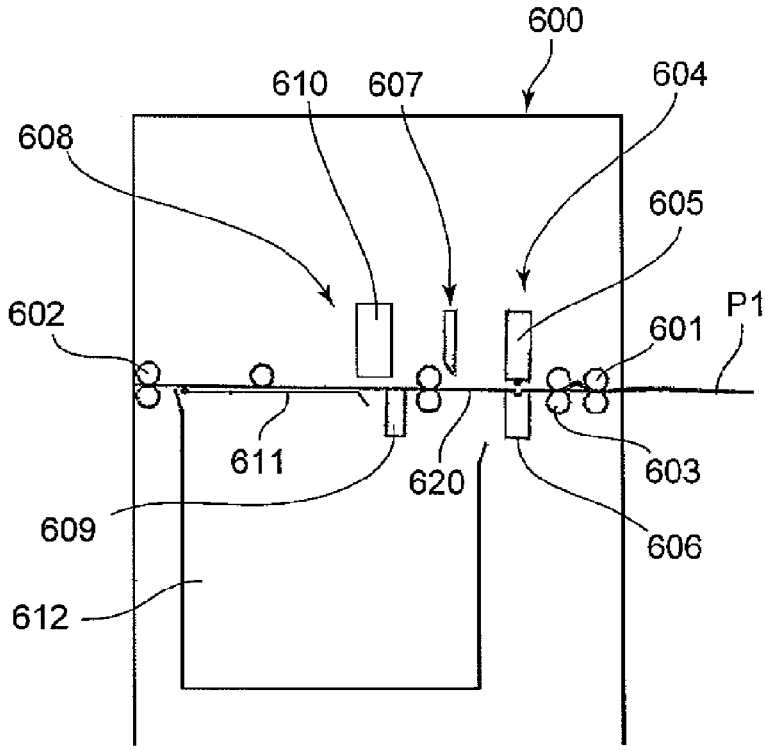
FIGS. 6A and 6B are diagrams for illustrating a processing operation which enables the finisher to produce a double-leaved sheet bundle.

First, the front cover P1 conveyed while sandwiched by the intake roller 601 strikes the stopped registration roller pair 603. Because the intake roller 601 continues to rotate after this, a loop is generated in the front cover P1 between the two rollers as shown in FIG. 6A so as to correct skew feeding of the front cover P1 accompanied by this.

Next, the registration roller pair 603 and the intake rollers 601 begin to rotate at an identical speed at a predetermined timing and when the front cover P1 is moved up to the cutting portion 608, they are stopped. Consequently, the front cover P1 is also stopped. The stop position of the front cover P1 is controlled so that when the sheet is cut by the cutting portion 608, the length in the conveying direction of the sheet excluding the projection shown in FIG. 7 described later is the same as that of the half size sheet.

Figure 7:
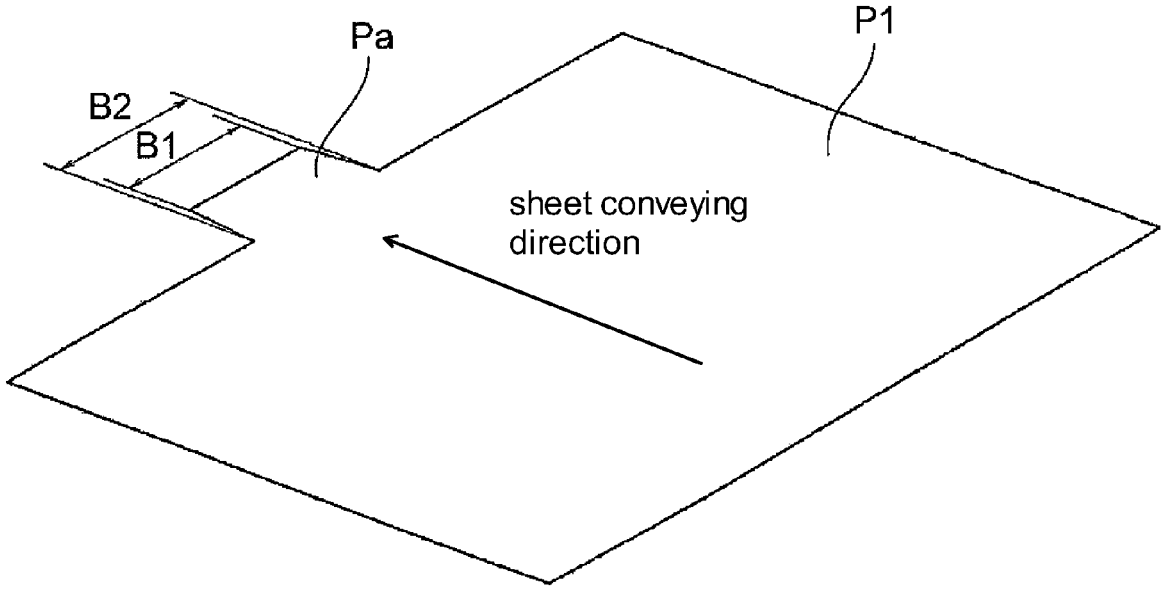
FIG. 7 is a perspective view illustrating the condition of a cover processed by the double-leaved booklet processing portion.

Next, the upper blade unit 610 of the cutting portion 608 is moved to the cutting position and then, the front end of the front cover P1 is cut. FIG. 7 shows the front cover P1 after cut in this way. In the meantime, according to this embodiment, the shape of the projection Pa of the front cover P1 turns to a trapezoid in which the width B1 of the front end portion is smaller than the width B2 of a root portion by the shape of the blade of the lower blade unit 609 and the upper blade unit 610 of the cutting portion 608.

Figure 6B:
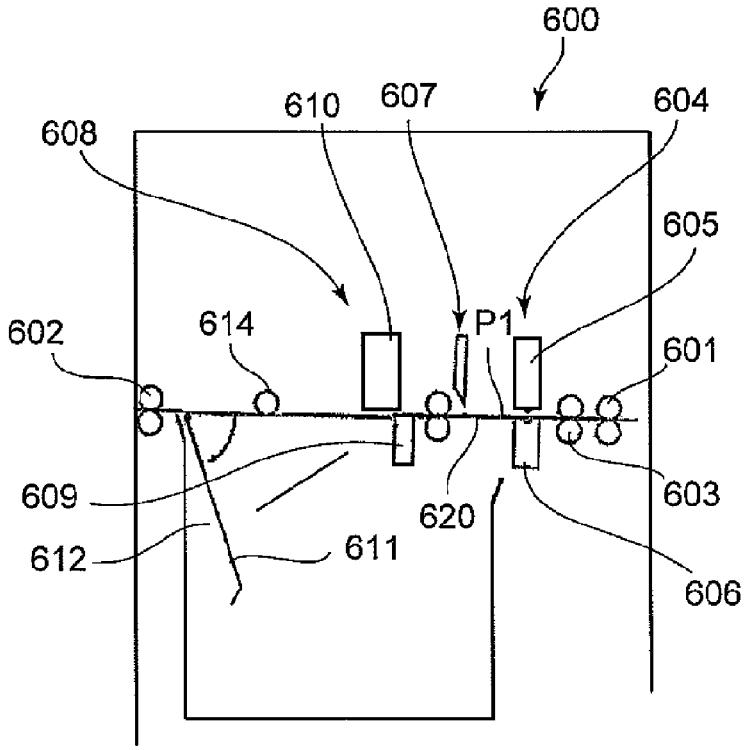

When the front end of the front cover P1 is cut, the shutter 611 rotates downward so that the cut front end portion of the front cover P1 drops from the shutter 611 and is accommodated in the trash box 612 (see FIG. 6B).

Figure 8:
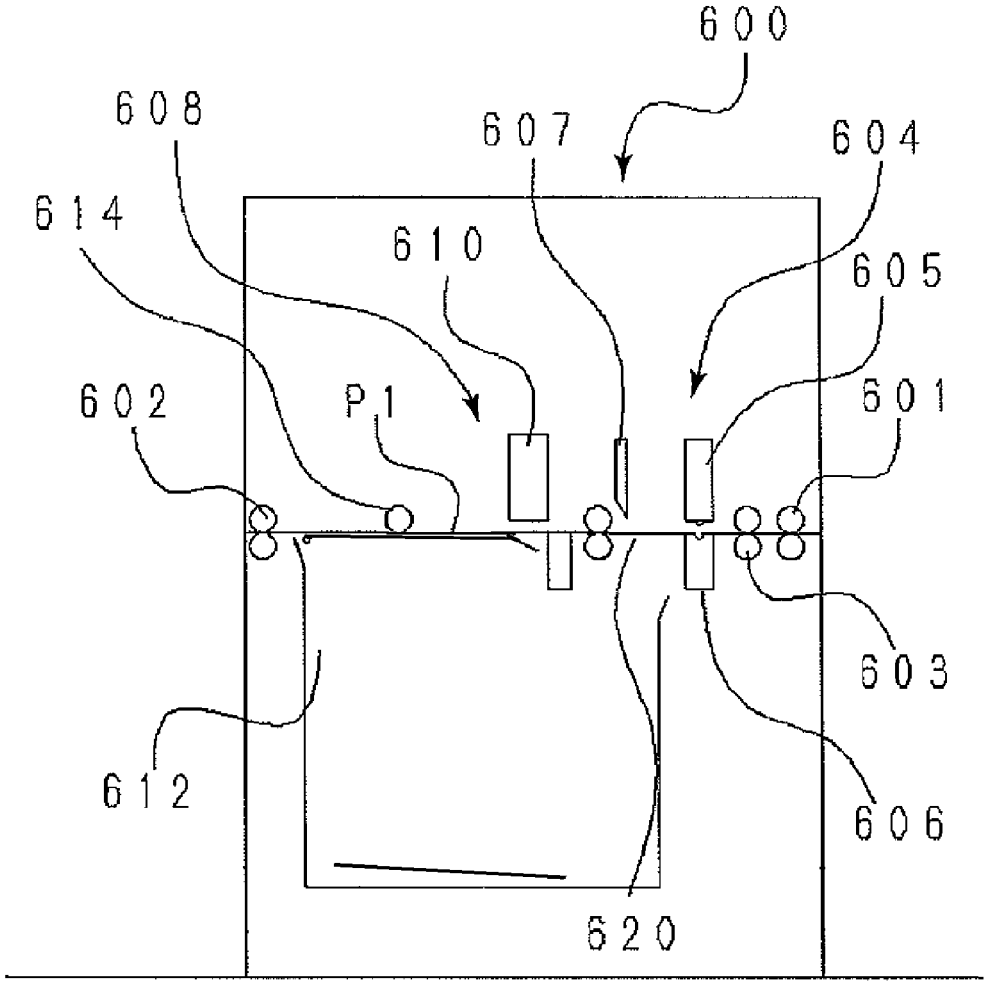
FIG. 8 is a second diagram illustrating processing operation which enables the finisher to produce a double-leaved sheet bundle.

After the front cover P1 is cut, when the upper blade unit 610 is moved to a standby position again, the shutter 611 rotates upward and returns to a position in which it agrees with the sheet passage face of the horizontal path 620. Then, after the shutter 611 rotates upward, the front cover P1 is nipped by the one side conveying roller 614 and the shutter 611 and conveyed to the finisher 500 as shown in FIG. 8.

Figure 9A:
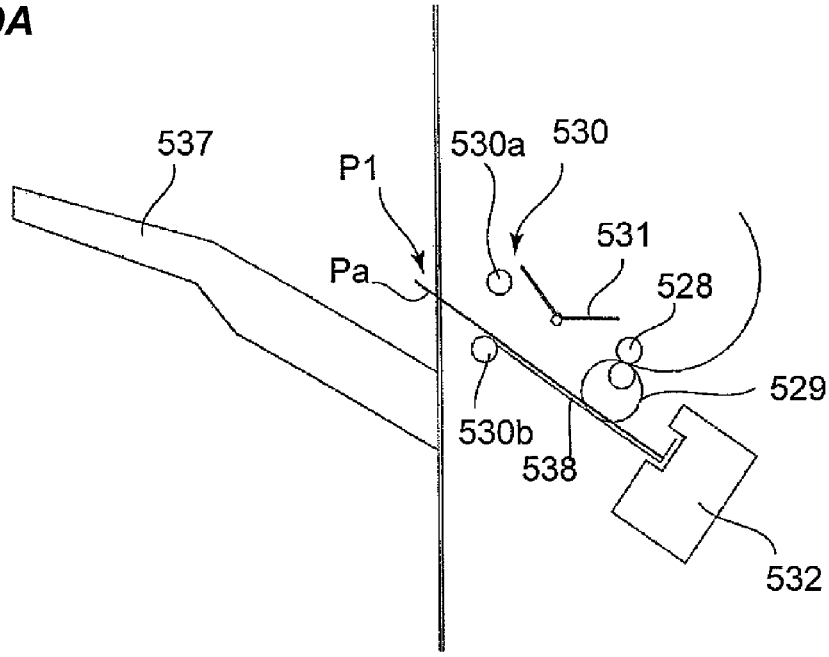
FIGS. 9A and 9B are third diagrams illustrating processing operation which enables the finisher to produce a double-leaved sheet bundle.

Next, the front cover P1 conveyed to the finisher 500 is discharged to the intermediate processing tray 538 as shown in FIG. 9A. At this time, an upper bundle discharge roller 530*a* which constitutes the bundle discharge roller pair 530 is separated from a lower bundle discharge roller 530*b* so that it is not an obstacle to discharge of the sheet. After that, the sheet is aligned and stacked by the paddle 531, the knurling belt 529 or a pair of aligning panels (not shown).

Figure 9B:
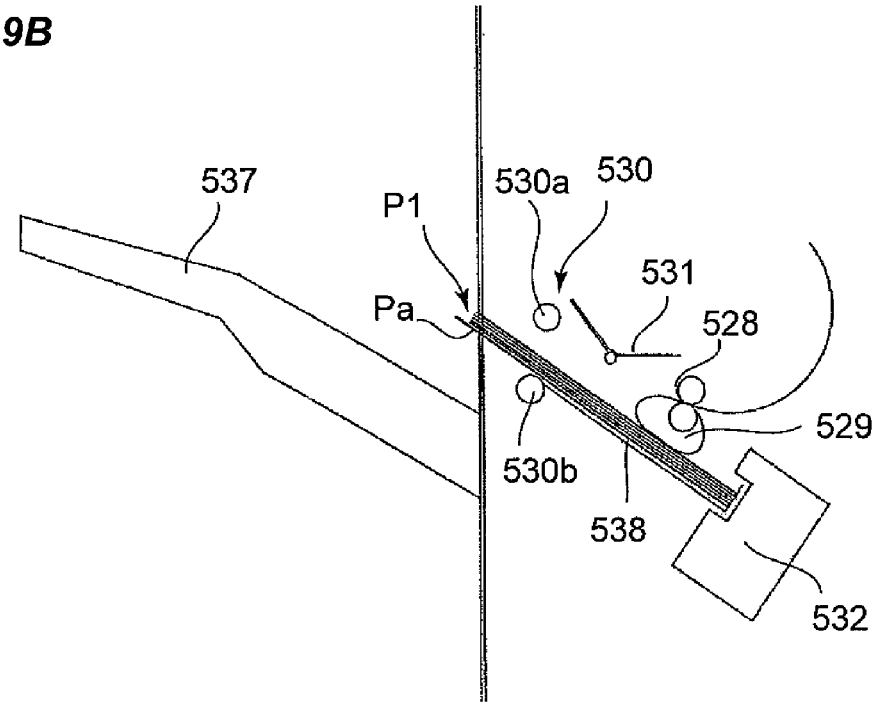

Subsequently, an intermediate sheet P2 other than the front cover P1 is supplied successively from the cassette 902*a* and after a desired image is formed, the sheets are aligned and stacked on the intermediate processing tray 538 as shown in FIG. 9B. In this while, the intermediate sheets P2 pass the double-leaved booklet processing portion 600 whose respective components are in standby state as shown in FIG. 4.

When the intermediate sheets P2 are aligned and stacked in succession in this way, the projection Pa in the center of the front end of the front cover P1 extending in a sheet conveying direction as compared with the intermediate sheet P2 remains projected as shown in FIG. 9B.

When a final sheet of the intermediate sheets P2 is stacked on the intermediate processing tray 538, a line sensor 539 (see FIG. 3) detects a thickness H of the sheet bundle. It is permissible to calculate the thickness of the sheet bundle with a number of sheets input through the operation portion 209 or by counting the number of sheets stacked on the intermediate processing tray 538.

After that, the back cover P3 is sent from the cassette 902*c* or the cassette 902*d* like the front cover P1. A desired image is formed on the back cover P3 sent in this way and after that, it enters the double-leaved booklet processing portion 600 so that it is nipped and conveyed by the intake rollers 601 and strikes the stopped registration roller pair 603 so as to correct skew feeding (see FIG. 6A).

Figure 10A:
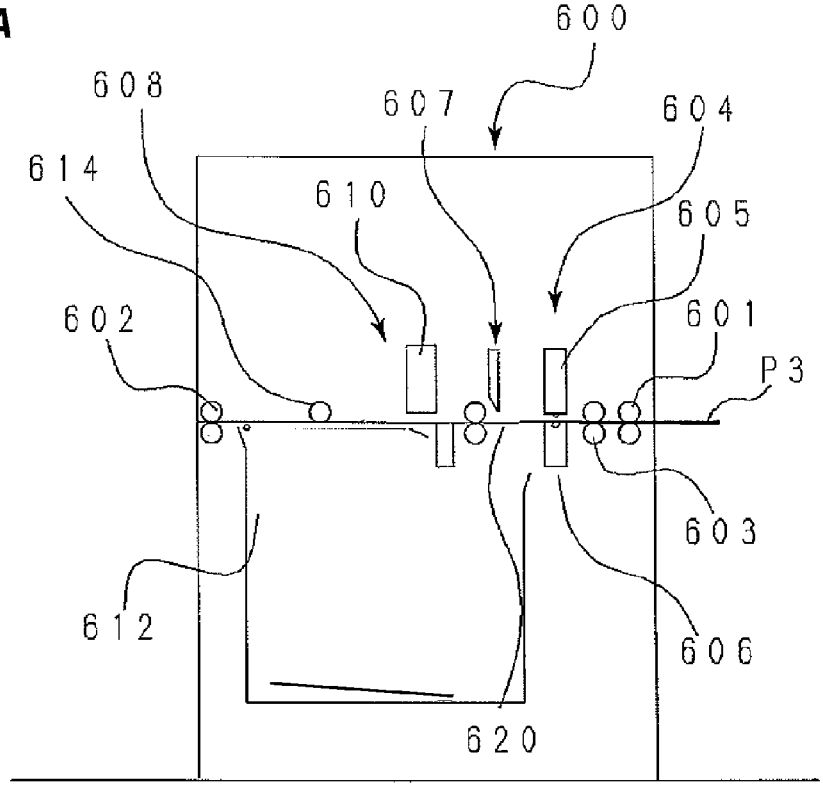
FIGS. 10A and 10B are fourth diagrams illustrating processing operation which enables the finisher to produce a double-leaved sheet bundle.
Figure 10B:
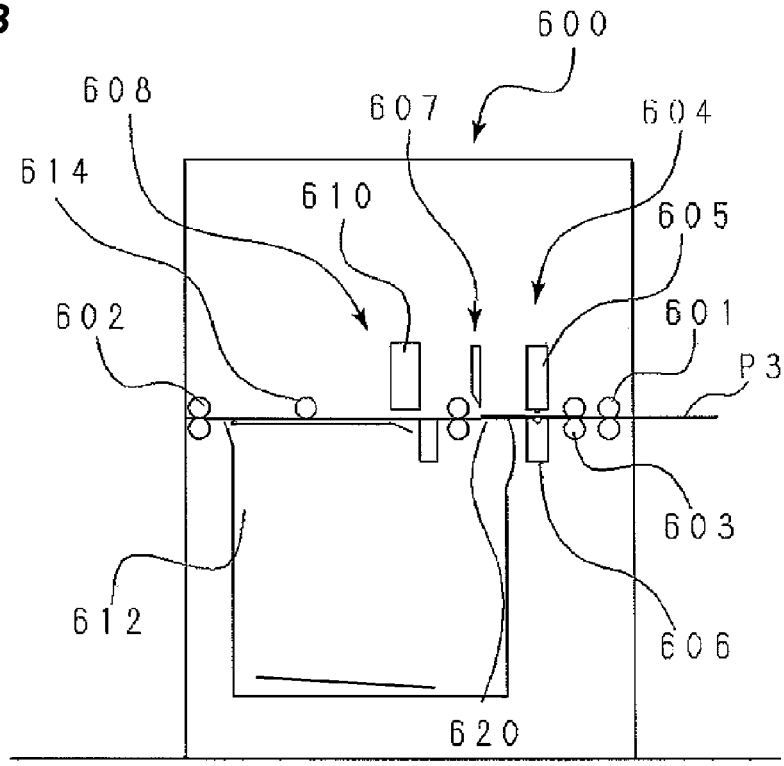

After the skew feeing is corrected by the registration roller pair 603, the back cover P3 is conveyed by the registration roller pair 603. At this time, the registration roller pair 603 is stopped twice by changing the position of the back cover P3 with respect to the creasing portion 604 as shown in FIGS. 10A and B.

Each time when the registration roller pair is stopped, the upper pressing die 605 descends to press the back cover P3. Consequently, as shown in FIG. 11, two creases L1, L2, extending in the width direction perpendicular to the sheet conveying direction are printed in the back cover P3.

Figure 11:
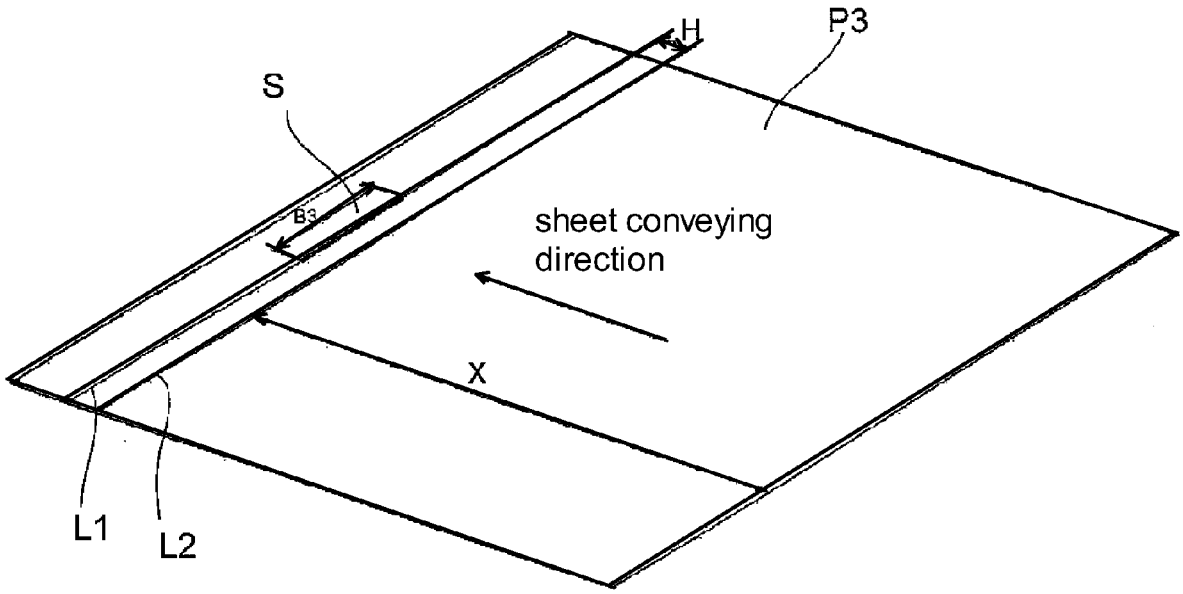
FIG. 11 is a perspective view illustrating the condition of a back cover processed by the double-leaved booklet processing portion.

As shown in FIG. 11, a distance X from the rear end of the back cover P3 to the second crease L2 on the upstream side in the sheet conveying direction is substantially the same as the length in the sheet conveying direction of the intermediate sheet P2. The first crease L1 and the second crease L2 are formed with a gap equivalent to the thickness H of the bundle stacked on the intermediate processing tray.

Further, the back cover P3 in which the two creases L1, L2 are printed is stopped twice by changing the position thereof at a position of the cutter portion 607. At a first cut by the cutter 616, the unnecessary portion at the front end is cut off by the cutter portion 607. Further, at a second cut, a slit S is made on the first crease L1 located on the front end side of the back cover P3, which is an end portion opposite to a side which is to be bound by the stapler 532. The cutting processing in any case is implemented at a position corresponding to the thickness H of the bundle stacked on the intermediate processing tray.

Figure 13A:
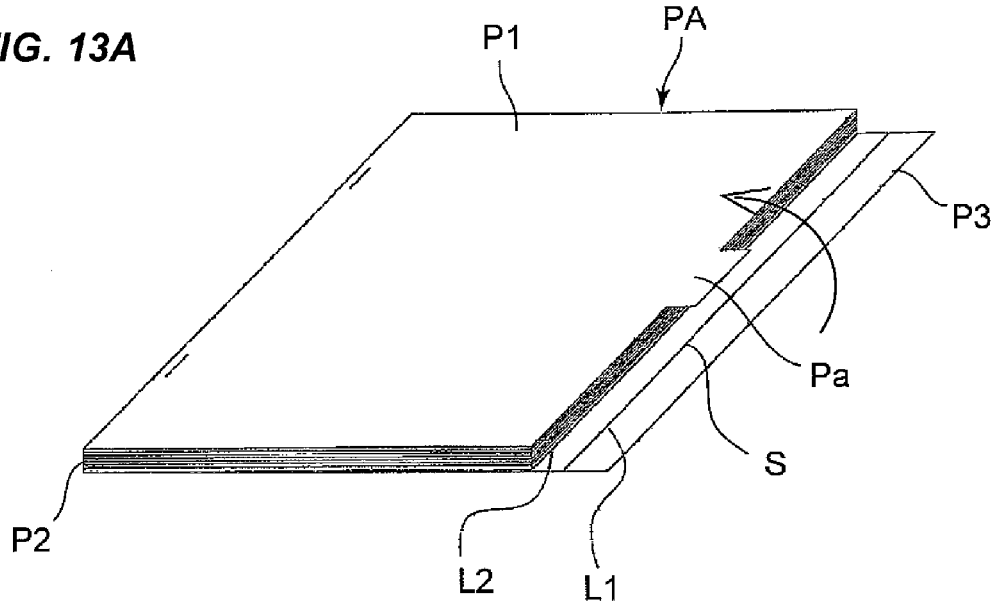
FIG. 13A is a perspective view of a booklet-like sheet bundle and FIG. 13B is a perspective view illustrating the state in which the booklet-like sheet bundle is converted to a double-leaved booklet by making the sheets double-leaved.
Figure 13B:
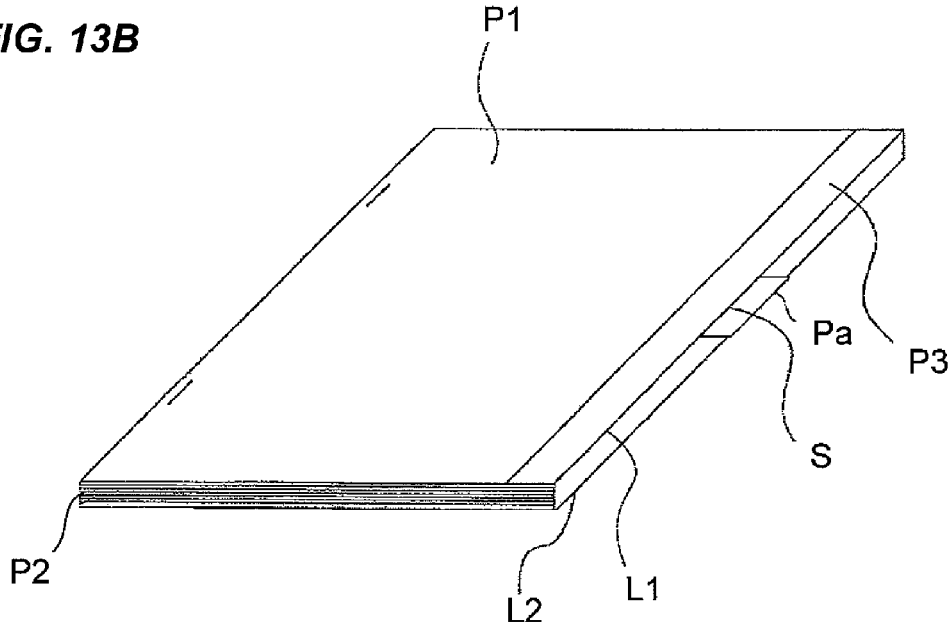

Consequently, when the sheet bundle is converted into a double-leaved state as shown in FIG. 13B, which will be described later, the intermediate sheets P2 can be covered without any gap and further, the projection Pa of the front cover P1 can be inserted into the slit S in the back cover P3 easily.

The slit S on the first crease L1 is formed at a position corresponding to the projection Pa at the front end of the front cover P1 as shown in FIG. 7 and cut to B3 which is a width dimension between the width B1 of the projection Pa and the width B2. Any trash generated by cutting the front end portion and the slit S is moved together with the back cover P3 and accommodated into the trash box 612 when the shutter 611 rotates downward.

Figure 12A:
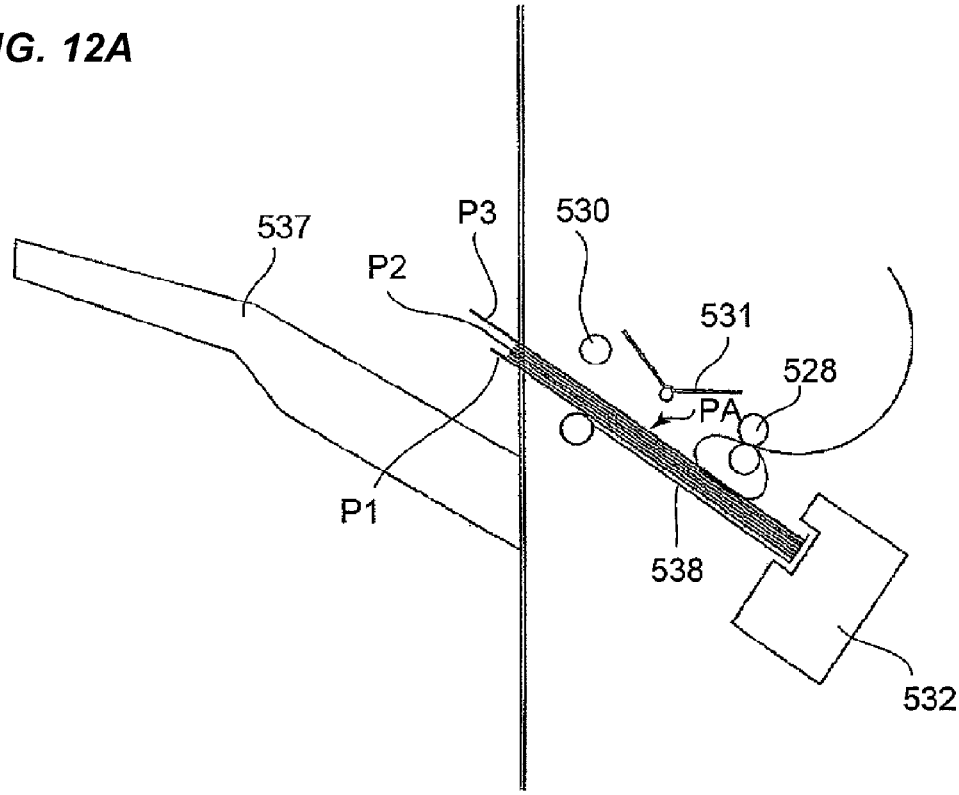
FIGS. 12A and 12B are fifth diagrams illustrating processing operation which enables the finisher to produce a double-leaved sheet bundle.
Figure 12B:
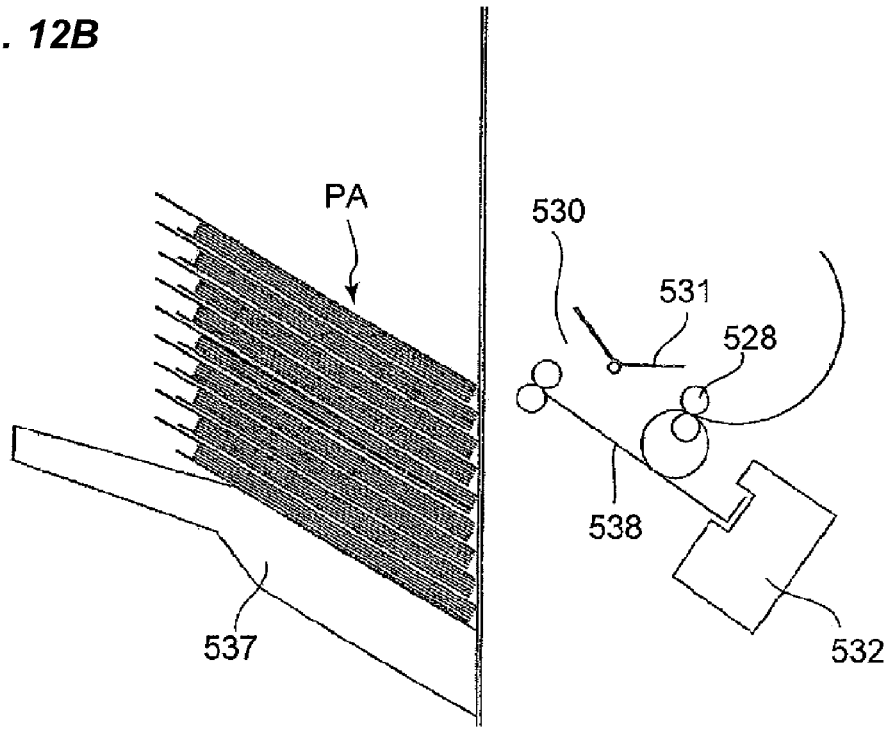

Next, the back cover P3 is conveyed to the finisher 500 and as shown in FIG. 12A, it is stacked on a topmost sheet of the intermediate sheet P2. Then, after the back cover P3 is stacked, alignment action is implemented and when the alignment action is ended, the stapler 532 staples two positions at the rear end portions (one end portion) of the sheet bundle PA. After that, the separated bundle discharge roller pair 530 is returned to a position for discharging the sheet bundle PA, the sheet bundles PA in a bound state is discharged to the bottom tray 537 as shown in FIG. 12B.

FIG. 13A is a perspective view of the sheet bundle PA in a booklet state discharged to the bottom tray 537. After the sheet bundle in this configuration is produced, the operator bends along the first and second creases L1, L2 at right angle in an arrow direction and insert the projection Pa of the front cover P1 into the slit S in the back cover P3.

Consequently, the sheet bundle in the booklet state is bound on additional end as shown in FIG. 13B, so that the double-leaved booklet is produced easily. In the meantime, because as described above, the width B3 of the slit S is smaller than the width B2 of the root of the projection Pa, in other words, the root of the projection Pa is formed wider than that of the front end portion while narrower than the slit S, the projection Pa never slips out of the slit S easily. Thus, the sheet bundle PA in the double-leaved state is never opened.

Figure 14:
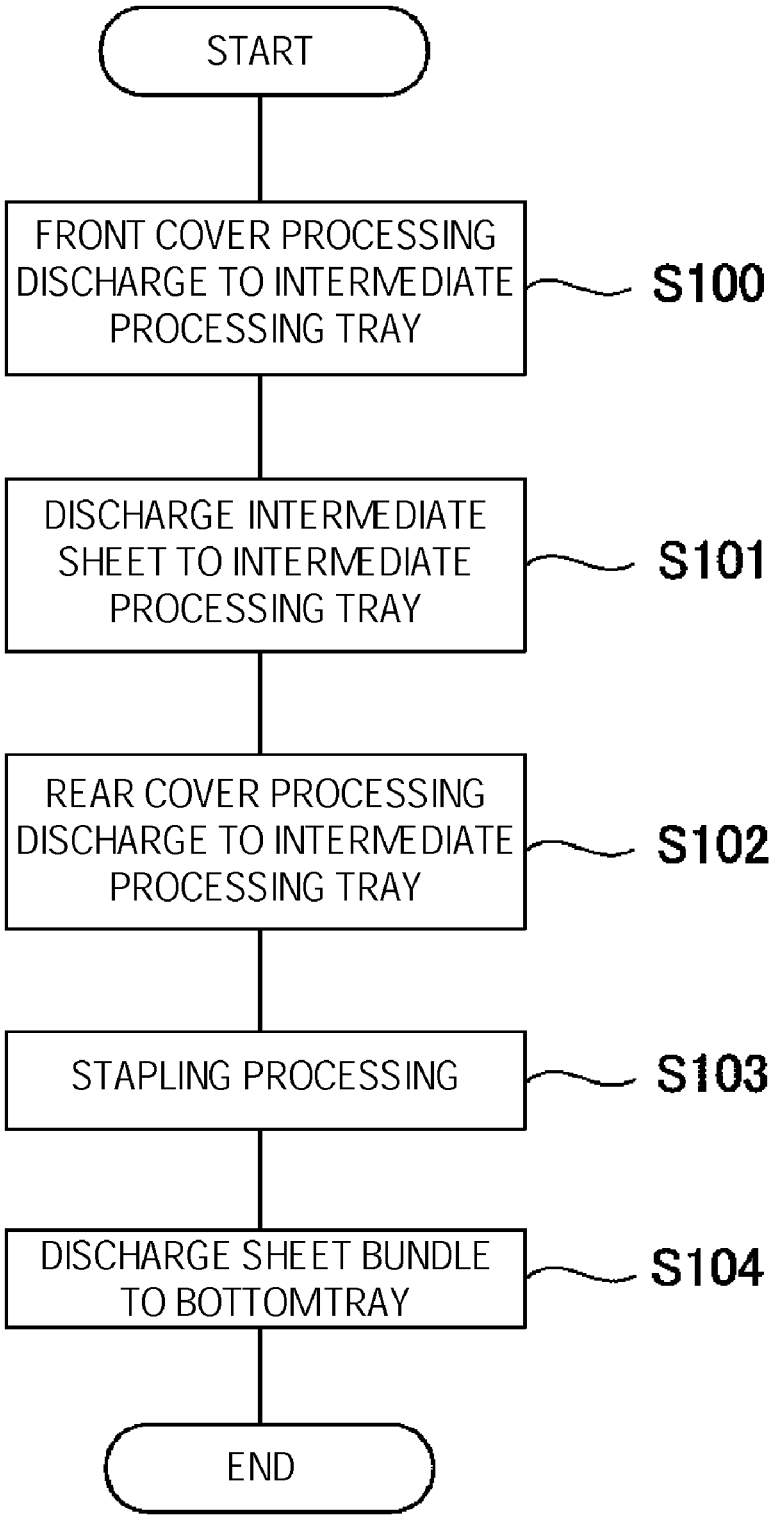
FIG. 14 is a flow chart illustrating the processing operation which enables the finisher to produce a double-leaved sheet bundle.

FIG. 14 is a flow chart describing a processing operation which enables the finisher 500 to process the sheet bundle to a double-leaved state.

In this case, after the projection Pa is formed at the front end of the front cover P1 by processing the front cover P1, the front cover P1 is discharged to the intermediate processing tray 538 (S100).

Next, the intermediate sheet P2 is discharged to the intermediate processing tray 538 (S101) and after that, the slit S and the first and second creases L1, L2 are formed by processing the back cover P3 and then, the back cover P3 is discharged to the intermediate processing tray 538 (P102). Finally, binding processing is carried out with the stapler 532 (S103) and the sheet is discharged to the bottom tray 537 (S104).

As described above, by forming the projection Pa on the front cover P1 and the slit S and the first and second creases L1, L2 on the back cover P3, the sheet bundle which can be double-leaved can be obtained. As a result, the double-leaved sheet bundle can be obtained without using any binding device at the fore edge of the sheets. Further, even if the double-leaved sheets are released, the sheet bundle can be returned to that binding state easily. Further, because the fore edges that are easily damaged can be protected by the front cover P1, the durability can be improved.

In the processing above, the projection Pa is formed on the front cover P1, the back cover P3 is formed into a length capable of covering the intermediate sheet P2, two creases L1, L2 are provided and then the slit portion is processed therein. However, it is permissible to form the front cover P1 in a length capable of covering the intermediate sheet P2, provide two creases L1, L2, process the slit therein and form the projection on the back cover P3.

That is, by forming the projection on any one of the front cover and the back cover and forming a plurality of the creases which enable the projection to be inserted into the slit while surrounding the sheets existing between the front cover and the back cover in the other one, the sheet bundle which can be double-leaved and released without use of any binding device can be obtained.

Although a case of forming the projection Pa by cutting the front end portion of a large size sheet by means of the cutting portion 608 has been described, it is permissible to use a marketed tab paper having a projection as a cover sheet.

Figure 15:
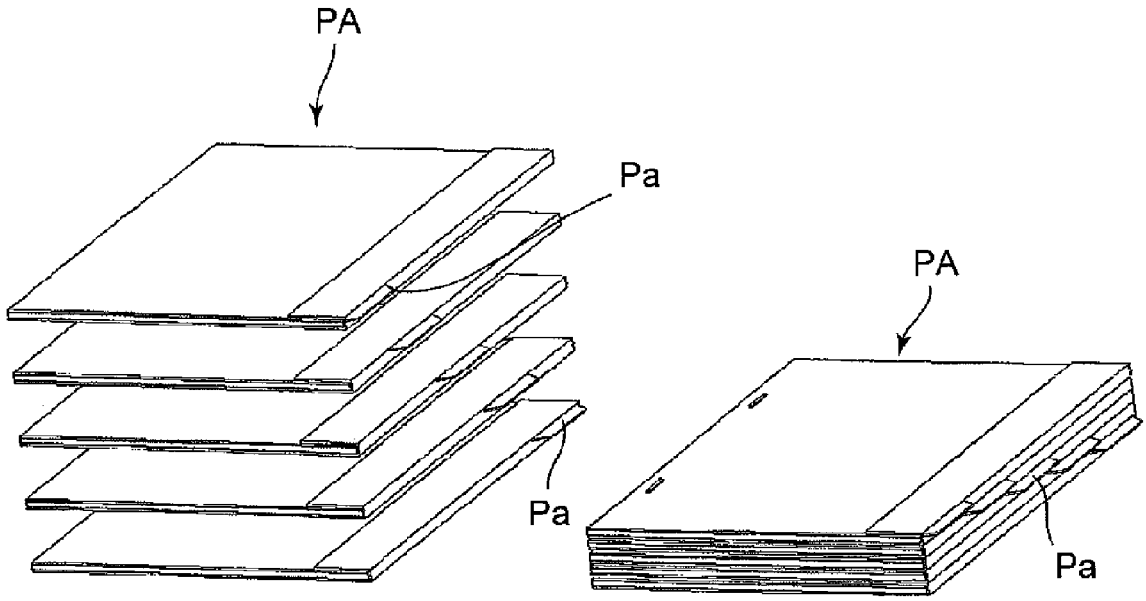
FIG. 15 is a diagram illustrating a sheet bundle which is processed to a double-leaved booklet, formed by the processing which enables the finisher to produce a double-leaved sheet bundle.

In this case, by inputting the position information of the tab and changing the formation position of the slit S depending on that position, the double-leaved booklet as shown in FIG. 15 can be created. In the meantime, if it is desired to use only a tab paper of a desired position, this can be achieved by adding that information.

Next, the second embodiment of the present invention will be described.

FIG. 16 is a perspective view of a sheet bundle which can be double-leaved, formed by the sheet processing apparatus of this embodiment. In FIG. 16, the same reference numerals as in FIG. 13 described above indicate like or corresponding portions.

According to this embodiment, as shown in FIG. 16, the slit S is formed in the vicinity of the front end which is an end portion side opposite to a side to be bound of the front cover P1. Further, the back cover P3 is formed in a length capable of covering the intermediate sheet P2 while the projection Pa is formed at the front end of the back cover P3 and two creases L1, L2 are provided.

Next, a processing operation which enables the finisher 500 of this embodiment to bind the sheet bundle double-leaved will be described. According to this embodiment, the front cover P1 is a thick paper of half size the same as the intermediate sheet P2 and supplied from the cassette 902*b*.

When the front cover P1 is conveyed to the double-leaved booklet processing portion 600 as described above, after skew feeding is corrected, the front cover is stopped at the cutter portion 607 and the cutter 616 opens the slit S in the vicinity of the front end of the front cover P1. After that, the front cover P1 is aligned and stacked on the intermediate processing tray 538 together with the intermediate sheet P2 supplied subsequently.

Next, the back cover P3 is supplied from the cassette 902*c* or 902*d*, it enters the double-leaved booklet processing portion 600 so as to correct the skew feeding. After that, two creases L1, L2 are provided by the creasing portion 604 and the front end of the back cover P3 is cut by the cutting portion 608 so as to form the projection Pa. In this embodiment also, the projection is formed at a position corresponding to the thickness H of the bundle stacked on the intermediate processing tray and the shape of the projection Pa of the back cover P3 is of trapezoid whose front end width is smaller than the root width.

After the projection Pa and the two creases L1, L2 are formed on the back cover P3, it is aligned and stacked on the intermediate processing tray 538 and after that, two end portions are stapled by a stapler 532. After that, the sheet bundle is discharged to the bottom tray 537.

Figure 16A:
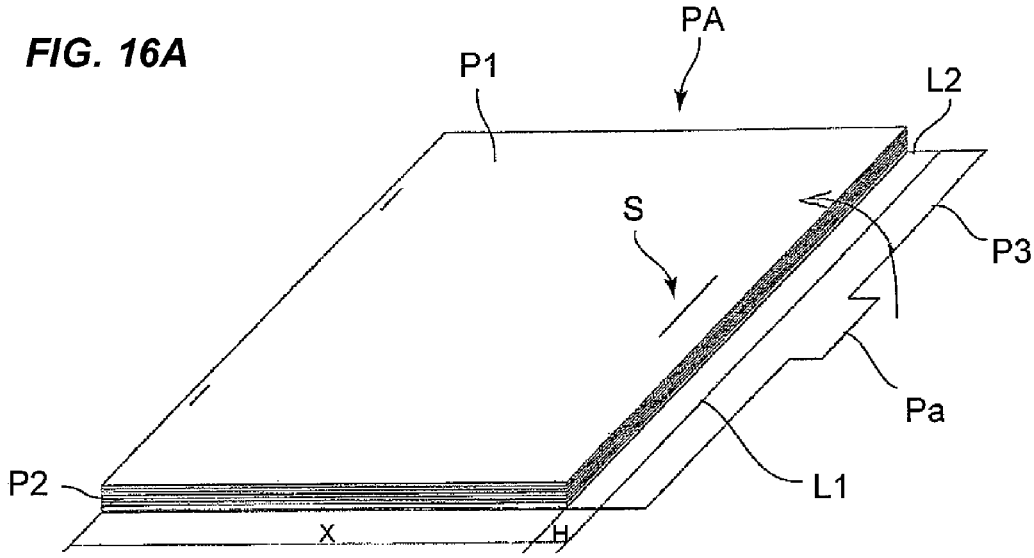
FIG. 16A is a perspective view of a sheet bundle which can be double-leaved, formed with the sheet processing apparatus according to the second embodiment of the present invention.

Then, the operator bends the creases L1, L2 in the back cover P3 of the sheet bundle PA produced in this way, shown in FIG. 16A at right angle in an arrow direction. In the meantime, a distance X from the rear end to the crease L2 of the back cover P3 is substantially the same as the length in the conveying direction of the intermediate sheet P2 and a gap between the creases L1 and L2 corresponds to a thickness H of the sheet bundle stacked on the intermediate processing tray. Further, the crease L1 is formed adjusting to the position of the slit S in the front cover P1 of the sheet bundle PA.

Figure 16B:
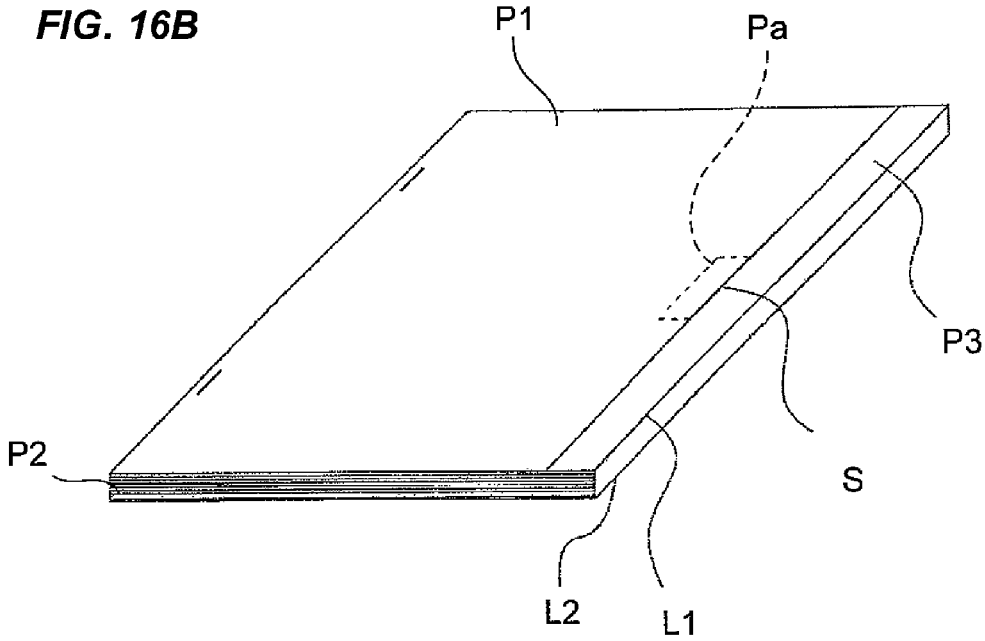
FIG. 16B is a perspective view illustrating a sheet bundle which is processed to a double-leaved booklet.

Further, after the creases L1, L2 are bent at right angle in an arrow direction, by inserting the projection Pa of the back cover P3 into the slit S in the front cover P1 as shown in FIG. 16B, the double-leaved booklet can be produced. The gap between the creases L1 and L2 is determined in accordance with the thickness H of the sheet bundle like the first embodiment.

In the first and second embodiments, the structure of forming both the slit S which is an insertion portion and the projection Pa to be inserted into the slit S in the double-leaved booklet processing portion 600 has been described above. However, a processed sheet may be inserted from the inserter 500B as a front cover or a back cover so as to produce a double-leaved booklet. For example, a marketed tab sheet may be inserted from the inserter 500B as a front cover or a back cover after the projection is formed and the double-leaved booklet processing portion 600 may form a slit adjusted to the width of the tab.

The double-leaved booklet, produced in the above way allows itself to be opened/closed any times by inserting or pulling out the projection Pa of the back cover P3 into/from the slit S. Because the fore edge of this booklet is covered with the thick covers P1, P3, it is hard to damage and secures an excellent durability.

Although two creases are provided in the example described above, if the number of the intermediate sheets P2 is small, it is permissible to provide a single crease in the front cover P1 which covers the fore edge of the intermediate sheet P2. That is, the number of the creases may be changed in accordance with to the thickness of the sheet.

Figure 17A:
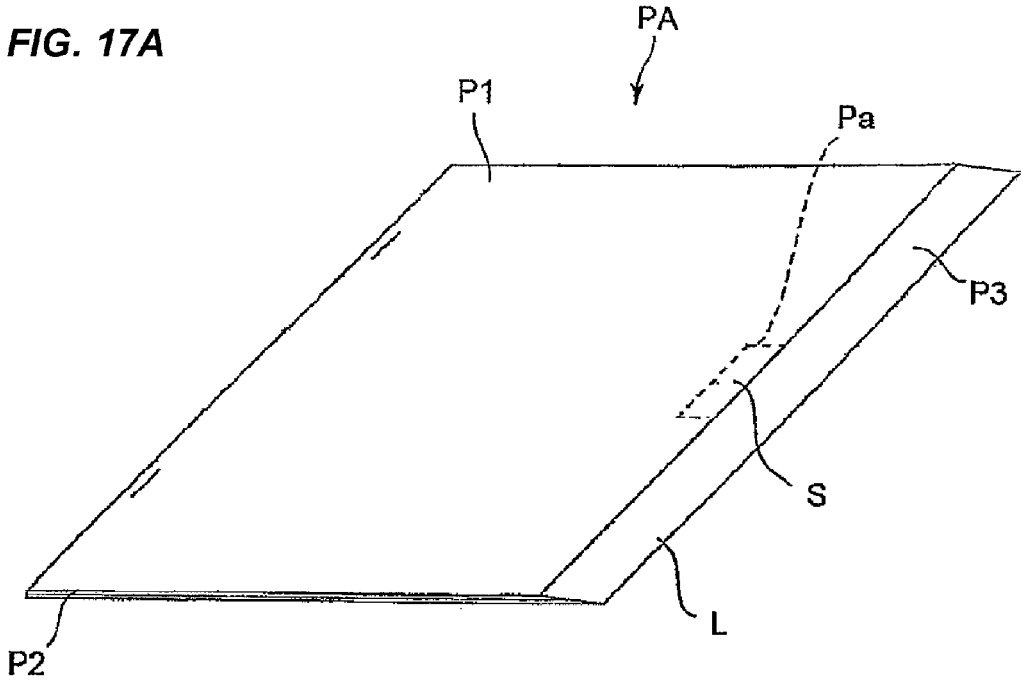
FIGS. 17A and 17B are perspective views illustrating another sheet bundle which is processed to a double-leaved booklet, formed by the sheet processing apparatus.
Figure 17B:
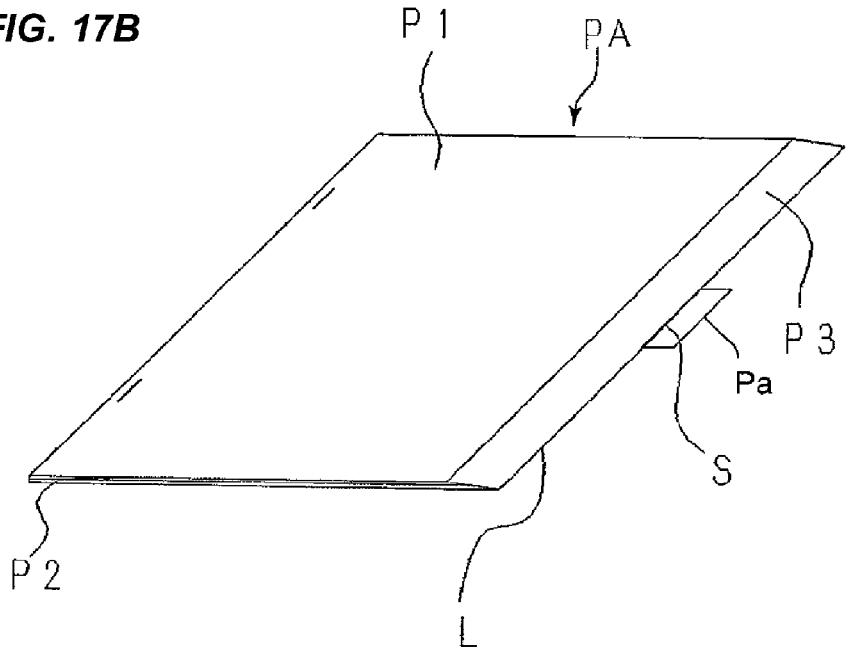
Figure 18A:
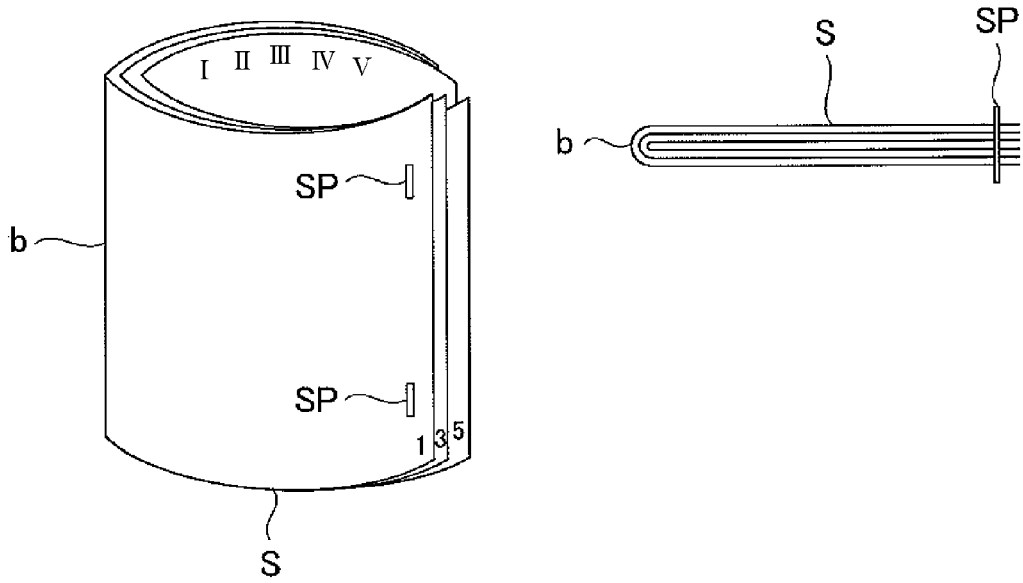
FIGS. 18A and 18B are diagrams illustrating a conventional method for blocking page sheets from being opened.
Figure 18B:
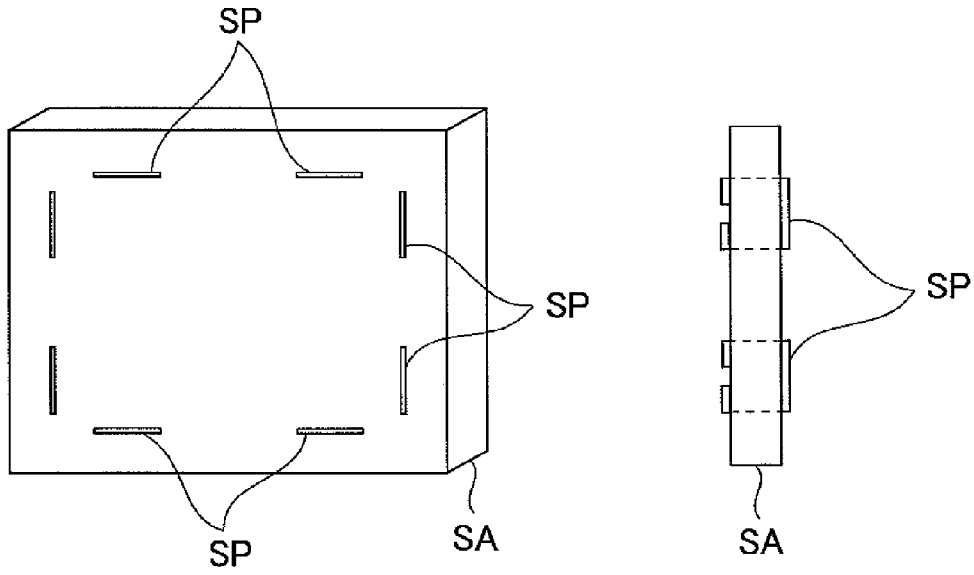

The reason is that if the thickness between the front cover and the back cover is too small, no sufficient gap H can be secured between the creases L1 and L2. FIG. 17A is a diagram illustrating a state in which the sheet bundle is converted to a double-leaved booklet and in FIG. 17B, the slit S is formed on a single crease L.

In the meantime, although in the first and second embodiments, the operations of inserting the projection into the slit and bending along the crease are carried out by the operator, it is permissible to provide a portion for executing that step on the double-leaved booklet processing portion 600. Although the shape in which the projection Pa is to be inserted is assumed to be a slit, the same booklet may be obtained even with a square hole having a width.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-207256, filed Aug. 8, 2007, and No. 2008-194492, filed Jul. 29, 2008, which are hereby incorporated by reference herein in their entirety.

What is claimed is:

1. A sheet processing apparatus which performs a processing of forming a sheet bundle having a front cover and a back cover, comprising:

a projection forming portion which forms a projection portion in an end portion of any one of the front cover and the back cover of the sheet bundle;

an insertion portion forming portion which forms an insertion portion to which the projection is to be inserted in the other one of the front cover and the back cover; and a binding portion which binds an opposite end portion of the sheet bundle to the end portion in which the projection is formed.

2. The sheet processing apparatus according to claim 1, further comprising:

a crease forming portion which forms a crease for inserting the projection into the insertion portion while surrounding sheets exist between the front cover and the back cover, in the other one of the front cover and the back cover.

3. The sheet processing apparatus according to claim 2, wherein when a plurality of the creases are formed, the crease forming portion is controlled to change a gap between the creases in accordance with the thickness of sheets existing between the front cover and the back cover.

4. The sheet processing apparatus according to claim 2, wherein the crease forming portion is controlled to change the number of the creases in accordance with the thickness of sheets existing between the front cover and the back cover.

5. The sheet processing apparatus according to claim 2, wherein when the crease and the insertion portion are formed in any one of the front cover and the back cover, the crease forming portion is controlled to form the insertion portion adjusted to the crease.

6. The sheet processing apparatus according to claim 5, wherein when a plurality of the creases are formed, the crease forming portion is controlled to form the insertion portion adjusted to a crease in an end portion opposite to the side to be bound by the binding portion, of the plurality of the creases.

7. The sheet processing apparatus according to claim 1, wherein the projection forming portion forms the projection such that the root portion of the projection is wider than the front end portion and narrower than the insertion portion.

8. The sheet processing apparatus according to claim 1, further comprising:

a crease forming portion which forms a crease for inserting the projection into the insertion portion while surrounding sheets exist between the front cover and the back cover, in the any one of the front cover and the back cover.

9. The sheet processing apparatus according to claim 8, wherein when a plurality of the creases are formed, the crease forming portion is controlled to change a gap between the creases in accordance with the thickness of sheets existing between the front cover and the back cover.

10. The sheet processing apparatus according to claim 8, wherein the crease forming portion is controlled to change the number of the creases in accordance with the thickness of sheets existing between the front cover and the back cover.

11. An image forming apparatus comprising:

an image forming portion which forms an image on a sheet; and the sheet processing apparatus according to claim 1, which processes the sheet on which the image is formed.

* * * * *